US008727913B2

(12) United States Patent
Morgan

(10) Patent No.: US 8,727,913 B2
(45) Date of Patent: May 20, 2014

(54) MULTI-COLOR GOLF BALL

(71) Applicant: Acushnet Company, Fairhaven, MA (US)

(72) Inventor: William E. Morgan, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 13 days.

(21) Appl. No.: 13/858,252

(22) Filed: Apr. 8, 2013

(65) Prior Publication Data

US 2013/0225334 A1 Aug. 29, 2013

Related U.S. Application Data

(60) Division of application No. 13/374,198, filed on Dec. 15, 2011, now Pat. No. 8,491,418, which is a continuation of application No. 13/373,599, filed on Nov. 21, 2011.

(51) Int. Cl.
*A63B 37/06* (2006.01)

(52) U.S. Cl.
USPC ..... 473/378

(58) Field of Classification Search
USPC ..... 473/378
See application file for complete search history.

(56) References Cited

U.S. PATENT DOCUMENTS

| | | | |
|---|---|---|---|
| 4,798,386 | A | 1/1989 | Berard |
| 6,949,595 | B2 | 9/2005 | Morgan et al. |
| 7,291,076 | B2 | 11/2007 | Watanabe |
| 7,722,483 | B2 | 5/2010 | Morgan et al. |
| 8,491,418 | B2 * | 7/2013 | Morgan ..... 473/378 |
| 2009/0137343 | A1 | 5/2009 | Morgan et al. |
| 2010/0227710 | A1 | 9/2010 | Morgan et al. |

OTHER PUBLICATIONS

PING Two Tone Golf Balls, p. 1-5, http://www.squidoo.com/pingtwocolorgolfballs, Nov. 16, 2011.
EBAY, 2 Ping Promotional Karsten eye Golf balls both bi color, p. 1-5, http://www.ebay.com/sch/sis.html?_nkw=2+Ping+promotional+Karsten+Eye+Golf+Balls, Nov. 16, 2011.
EBAY Guides, Ping Golf Balls, Tips for Collecting Two-Colored Eyes, p. 1-3, Nov. 16, 2011.
EBAY, Ping Two Colored Golf Balls, p. 1-3, Nov. 16, 2011.
NitroGolf.com, Nitro Blaster p. 1-3, Nov. 16, 2011.
Amazon.com: Nitro Eclipse 12-Pack Golf Balls: Sports & Outdoors, p. 1-5, Nov. 16, 2011.
Nitro Eclipse Golf Balls, Crystal Golf Balls.com, p. 1-2, Nov. 16, 2011, www.crystalgolfballs.com/nitroeclipsegolfballs.aspx.
Executive Putter Pool, Sunset Golf, Inc.
HPG Hansberger Precision Golf, 1996 Game Improvement Golf Balls, Golden Girl the Ladies Choice, HPG 15 Custom Crested Golf Balls HPG 16 &HPG 17.

* cited by examiner

*Primary Examiner* — Raeann Gorden
(74) *Attorney, Agent, or Firm* — Margaret C. Barker

(57) ABSTRACT

The present invention is directed to a golf ball possessing an overall unique and perceptively pleasing multi-color appearance and being constructed of at least two layers wherein each layer has at least two discrete color regions which contribute substantially to the golf ball's overall color appearance, the inner and outer layers being strategically positioned and aligned in relation to each other to create the overall golf ball color appearance. A resulting unique overall golf ball multiple color appearance is achieved by the positioning and aligning one layer about another.

3 Claims, 10 Drawing Sheets

MULTI-COLOR GOLF BALL

CROSS-REFERENCE TO RELATED APPLICATIONS

This application is a divisional of co-pending U.S. application Ser. No. 13/374,198, which is a continuation of co-pending U.S. application Ser. No. 13/373,599, filed Nov. 21, 2011, the entire disclosure of each of which is hereby incorporated by reference herein.

FIELD OF THE INVENTION

The invention relates generally to golf balls incorporating color, pigments dyes, tints and color effects to optimize golf ball appearance and golfer performance on the green.

BACKGROUND OF THE INVENTION

Golf balls, whether of solid or wound construction, generally include a core and at least a cover or outer coating. The properties of a conventional solid ball may be modified by altering the typical single layer core and single cover layer construction to provide a ball having at least one mantle layer disposed between the cover and the core. The core may be solid or liquid-filled, and may be formed of a single layer or one or more layers. Covers, in addition to cores, may also be formed of one or more layers. These multi-layer cores and covers are sometimes known as "dual core" and "dual cover" golf balls, respectively. Additionally, many golf balls contain one or more intermediate layers that can be of solid construction or may be formed of a tensioned elastomeric winding, which are referred to as wound balls. One piece golf balls are even available. The difference in play characteristics resulting from these different types of constructions can be quite significant. The playing characteristics of multi-layer balls, such as spin and compression, can be tailored by varying the properties of one or more of these intermediate and/or cover layers.

Moreover, color in a golf ball, being a dominant visual feature, is also capable of positively contributing to and enhancing a golfer's game by improving the player's ability to focus on the golf ball when swinging a club and striking the ball. It is desirable that a golfer's eye be drawn to the ball easily. By keeping an eye on the ball, the golfer is able to remain focused on the immediate task at hand of maintaining hand-eye coordination and producing great balance during swing with consistent spine angle in order for the club face to strike the golf ball with just the right force, depending on the chosen club and desired distance. In this way, a golf ball's unique visual appearance can influence and improve the golfer's physical performance substantially.

Meanwhile, golf balls that are attractive and exude superior quality will also positively contribute to the psychological aspects of a golfer's game by boosting the golfer's confidence and morale, thereby motivating, inspiring and ultimately peaking performance on the green. Additionally, visually superior golf balls may be spotted and located more easily on the golf course, thereby reducing a player's stress level which naturally translates into improved scores. Accordingly, golf ball manufacturers desire to incorporate color in golf balls in order to beneficially impact and improve both the physical and emotional/psychological aspects of a golfer's game.

Toward this end, there remains a need for golf balls having superior overall color appearance to the human eye. The present invention addresses and solves this problem.

SUMMARY OF THE INVENTION

The present invention is directed to a golf ball possessing an overall unique and perceptibly pleasing multi-color appearance and being constructed of at least two layers wherein each layer has at least two color regions which contribute substantially to the golf ball's overall color appearance, the inner and outer layers being strategically positioned and aligned in relation to each other to create the overall golf ball color appearance. A resulting superior overall golf ball multiple color appearance is achieved by the positioning and aligning one layer about another.

In one embodiment, the golf ball has two layers which contribute to the overall color appearance of the golf ball, the two layers comprising an inner layer and an outer layer. The inner layer is comprised of at least two different colors and the outer layer is comprised of two different colors. The inner layer comprises a first color region W and a second color region X and the outer layer comprises a third color region Y and a fourth color region Z. At least one of color regions Y and Z is translucent. Color region Y and color region Z are positioned and aligned about color region W and color region X such that the golf ball has an overall color appearance comprised of at least three different colors.

Color regions Y and Z may have either substantially equal translucency, different translucency, or one of color regions Y and Z may even be opaque.

In a specific embodiment, the inner layer is comprised of two different colors, each color region being a different color. In this embodiment, depending on the surface area of each color region, the translucency/opacity of the outer layer, and the positioning and alignment of the outer core layer about the inner core layer, the overall color appearance may be comprised of either three different colors, four different colors, or at least four different colors.

An embodiment is also envisioned wherein the inner layer may alternatively be comprised of greater than two color regions.

Where the overall color appearance is comprised of three different colors, in two non-limiting embodiments:

(1) substantially a first half of the overall color appearance may be comprised of color C1 and substantially a second half of the overall color appearance be substantially equally divided into colors C2 and C3; wherein $C1 \neq C2$, $C1 \neq C3$, and $C2 \neq C3$; or (2) substantially a first half of the overall color appearance may be comprised of color C1 and substantially a second half of the overall color appearance be divided into colors C2 and C3 such that $C1 \neq C2$, $C1 \neq C3$ and $C2 \neq C3$; and wherein C2 has a surface area S1 and C3 has a surface area S2 such that $S1 \neq S2$.

Where the overall color appearance is comprised of four different colors, in three non-limiting embodiments:

(1) the overall color appearance of the golf ball may be divided into four color regions having substantially equivalent surface areas, wherein each color region is comprised of a different color; or (2) the overall color appearance of the golf ball may be divided into four color regions that do not all have substantially equivalent surface areas; and wherein each color region is comprised of a different color; or (3) the overall color appearance of the golf ball may be divided into four color regions wherein two of the color regions have substantially equivalent surface areas and two of the color regions have different surface areas; and wherein each color region is comprised of a different color.

In another embodiment, the golf ball has two layers which contribute to an overall color appearance of the golf ball, the two layers comprising an inner layer and an outer layer, the inner layer and outer layer each comprised of two different colors. The inner layer comprises a first color region W having a surface area A and a second color region X having a surface area B wherein A≠B. The outer layer comprises a third color region Y having a surface area C and a fourth color region Z having a surface area D, wherein at least one of color regions Y and Z is translucent. Color region Y and color region Z are positioned about colored region W and color region X and surface area C and surface area D are aligned with surface area A and surface area B such that the golf ball has an overall color appearance comprised of at least two different colors. In one embodiment, C=D. In another embodiment, C≠D.

Once again, depending on the surface area of each color region, the translucency/opacity of an outer layer and the positioning and alignment of the outer core layer about the inner core layer, the overall color appearance in these aforementioned embodiments may be comprised of either at least two different colors, two different colors, at least three different colors, three different colors, at least four different colors, or four different colors.

In yet another embodiment, the golf ball has two layers which contribute to an overall color appearance of the golf ball, the two layers comprising an inner layer and an outer layer, and the inner layer and outer layer each being comprised of two different colors. The inner layer comprises a first color region W having a surface area A and a second color region X having a surface area B wherein A=B. The outer layer comprises a third color region Y having a surface area C and a fourth color region Z having a surface area D, wherein color regions Y and Z are translucent or one of color regions Y and Z is opaque. Color region Y and color region Z are positioned about colored region W and color region X, and surface area C, and surface area D are aligned with surface area A and surface area B such that the golf ball has an overall color appearance comprised of at least three different colors. In one embodiment, C=D. In another embodiment, C≠D.

Yet again, depending on the surface area of each color region, the translucency/opacity of the outer layer and the positioning and alignment of the outer core layer about the inner core layer, the overall color appearance may be comprised of either at least three different colors, three different colors, at least four different colors, or four different colors.

In still another embodiment of the invention, a golf ball has two layers which contribute to an overall color appearance of the golf ball, the two layers comprising an inner layer and an outer layer, the inner layer and outer layer each comprised of two different colors. The inner layer comprises a colored region W having a surface area A and a colored region X having a surface area B wherein either A≠B or A=B. The outer layer comprises a colored region Y having a surface area C and a colored region Z having a surface area D such that C=D wherein at least one of color regions Y and Z is translucent. Color regions Y and Z having a boundary P such that:

(i) for A≠B:

(1) where boundary P intersects region W and regions Y and Z are translucent, the golf ball has an overall color appearance of 4 different colors;

(2) where boundary P does not intersect region W and regions Y and Z are translucent, the golf ball has an overall color appearance comprised of 3 different colors;

(3) where boundary P intersects region W and at least one of regions Y and Z is opaque, the golf ball has an overall color appearance comprised of 3 different colors;

(4) where boundary P does not intersect region W and one of regions Y and Z is opaque, the golf ball has an overall color appearance comprised of at least two different colors; or (ii) for A=B:

(1) where boundary P is orthogonal to a boundary L of color regions W and X, and color regions Y and Z are translucent, the golf ball has an overall color appearance comprised of four different colors;

(2) where boundary P is not orthogonal to a boundary L of color regions W and X, and color regions Y and Z are translucent, the golf ball has an overall color appearance comprised of 4 different colors;

(3) where boundary P is orthogonal to a boundary L of color regions W and X, and one of color regions Y and Z is opaque, the golf ball has an overall color appearance comprised of 3 different colors; and (4) where boundary P is not orthogonal to a boundary L of color regions W and X, and one of color regions Y and Z is opaque, the golf ball has an overall color appearance comprised of at least 2 different colors.

In one embodiment, boundary P is a parting line. In another embodiment, boundary P is not a parting line. Also, boundary L may or may not be a parting line.

In one embodiment, boundary P is planar. In another embodiment, boundary P is non-planar. Meanwhile, boundary L may or may not be planar.

In an alternative embodiment of the invention, the golf ball has two layers which contribute to the overall color appearance of the golf ball, the two layers comprising an inner layer and an outer layer; the inner layer being comprised of at least three different colors and the outer layer being comprised of two different colors. The inner layer comprises a first color region W, a second color region X and a third color region T and the outer layer comprises a fourth color region Y and a fifth color region Z. At least one of color regions Y and Z is translucent and color regions Y and Z have a boundary P that does not intersect color region X or color region T such that the golf ball has an overall color appearance comprised of two different colors.

In one embodiment, boundary P is planar. In another embodiment, boundary P is non-planar. And boundary P may or may not be a parting line.

In a different embodiment, the golf ball of the invention has two layers which contribute to the overall color appearance of the golf ball, the two layers comprising an inner layer and an outer layer; the inner layer comprised of at least three different colors and the outer layer comprised of two different colors. The inner layer comprises a first color region W, a second color region X and a third color region T, and the outer layer comprises a fourth color region Y and a fifth color region Z. At least one of color regions Y and Z is translucent and color regions Y and Z have a boundary P that intersects at least one of color region X and color region T such that the golf ball has an overall color appearance comprised of three different colors.

In one embodiment, boundary P is planar. In another embodiment, boundary P is non-planar. Meanwhile, boundary P may or may not be a parting line.

In yet a different embodiment, the golf ball of the invention has two layers which contribute to the overall color appearance of the golf ball, the two layers comprising an inner layer and an outer layer, the inner layer comprised of at least three different colors and the outer layer comprised of two different colors. The inner layer comprises a first color region W, a second color region X and a third color region T and the outer layer comprises a fourth color region Y and a fifth color region Z. At least one of color regions Y and Z is translucent; and color regions Y and Z have a boundary P that intersects both of color region X and color region T such that the golf ball has an overall color appearance comprised of six different colors.

In one embodiment, boundary P is planar. In another embodiment, boundary P is non-planar. Boundary P may or may not be a parting line.

A golf ball of the invention may also have two layers which contribute to the overall color appearance of the golf ball, the two layers comprising an inner layer and an outer layer; the inner layer comprised of at least three different colors and the outer layer comprised of two different colors. The inner layer comprises a first color region W, a second color region X and a third color region T and the outer layer comprises a fourth color region Y and a fifth color region Z. At least one of color regions Y and Z is translucent and color region Y and color region Z are positioned and aligned about color region W, color region X and color region T such that the golf ball has an overall color appearance comprised of at least two different colors.

In another embodiment, a golf ball of the invention has two layers which contribute to the overall color appearance of the golf ball, the two layers comprising an inner layer and an outer layer; the inner layer comprised of at least two different colors and the outer layer comprised of two different colors. The inner layer comprise a first color region W and a second color region X, the outer layer comprises a third color region Y and a fourth color region Z, wherein at least one of color regions W and X is divided into two or more color sub-regions that are surrounded by an encasing color sub-region, wherein the color sub-regions and the encasing color sub region are different colors. At least one of color regions Y and Z is translucent and color region Y and color region Z are positioned and aligned about color region W and color region X such that the golf ball has an overall color appearance comprised of at least three different colors.

In one embodiment, the two or more color sub-regions are symmetrical. In another embodiment, the two or more color sub-regions are asymmetrical.

A golf ball of the invention may alternatively have three layers which contribute to an overall color appearance of the golf ball. The three layers may comprise an inner layer, an outer layer; and an intermediate layer, the inner layer, outer layer and intermediate layer each being comprised of two different colors, the inner layer comprising a first color region W and a second color region X, the outer layer comprising a third color region Y and a fourth color region Z, the intermediate layer comprising a fifth color region R and a sixth color region S. Color regions Y, Z, R and S may all be translucent; (or) color region Y or color region Z may be opaque while color region R and color region S are translucent; (or) color region R or color region S is opaque while color region Y and color region Z are translucent; (or) one of color regions Y and Z is opaque and one of color regions R and S are opaque. And color region Y and color region Z are positioned and aligned about color regions W, X, R and S such that the golf ball has an overall color appearance comprised of at least three different colors.

Depending on the surface area of each color region, the translucency/opacity of the outer layer and the positioning and alignment of the outer core layer, intermediate layer and inner core layer, the overall color appearance in these immediately preceding embodiments may be comprised of either at least three different colors, three different colors, at least four different colors, four different colors, at least five different colors, five different colors, at least six different colors or six different colors.

In one embodiment, an inventive golf ball has two layers which contribute to the overall color appearance of the golf ball, the two layers comprising an inner layer and an outer layer, the inner layer comprised of at least three different colors and the outer layer comprised of two different colors. The inner layer comprises a first color region W, a second color region X and a third color region T and the outer layer comprises a fourth color region Y and a fifth color region Z. At least one of color regions Y and Z is translucent and at least one of color regions W, X and T is divided into two or more color sub-regions that are mutually located within and/or about at least one other color-sub region, wherein the two or more color sub-regions and the at least one other color sub-region are different colors.

In one embodiment, the two or more color sub-regions are symmetrical. In another embodiment, the two or more color sub-regions are asymmetrical. In yet another embodiment, the two or more color sub-regions and the at least one other color sub-region are symmetrical. Alternatively, the two or more color sub-regions and the at least one other color sub-region may be asymmetrical.

In a golf ball of the invention, the term "color region" refers to a discrete and generally uniformly colored surface area on a golf ball layer which is capable of contributing substantially to at least one portion of the golf ball's overall color appearance. A "golf ball layer" includes any of an outer core layer, intermediate layer, mantle layer, inner cover layer, outer cover layer and coating. Herein, the phrase "capable of" means that a color region will contribute substantially to the golf ball's overall color appearance unless that color region is entirely covered/blocked by an opaque outer layer color region. In such a case, how the opaque outer layer color region is positioned and/or aligned about and in relation to the inner layer color region will dictate the degree to which the inner layer color region actually visibly contributes to the overall golf ball color appearance of the resulting golf ball as view from the surface. When an inner layer color region is partially covered by an opaque outer layer color region, the inner layer color region may indeed nevertheless contribute substantially to at least one portion of the golf ball's overall color appearance, depending on how much of the inner layer color region is blocked from surface view by the opaque outer layer color region. This consideration does not apply when outer layers are translucent and therefore inner layers are always totally visible.

A color region is "capable of" contributing substantially to a portion the golf ball's overall color appearance where the color region's surface area is sufficiently large in comparison with the total surface area of the layer in which the color region lies. For example, colored flakes, particulates, glitter specs, whiskers, fibers, filaments, lettering or other indicia dispersed throughout a layer, while capable of enhancing/accentuating a golf ball's overall appearance, are not capable of substantially contributing to an entire portion or section of a golf ball's overall appearance due to their individual minute surface areas.

In one embodiment of the invention, at least one color region of the golf ball has a surface area that is at least about 50% of the total surface area of the layer in which the color region lies. In another embodiment, at least one color region of the golf ball has a surface area that is at least about 25% of the total surface area of the layer in which the color region lies. In yet another embodiment, at least one color region of the golf ball has a surface area that is at least about 30% or at least about 20% or at least about 10% or even at least about 5% of the total surface area of the layer in which the color region lies. In still another embodiment, at least one color region of the golf ball has a surface area that is at least about $1/5^{th}$ the total surface area of the layer in which the color region lies. Alternatively, at least one color region of the golf ball has a surface area that is at least about $1/6^{th}$ or $1/7^{th}$ or $1/8^{th}$ or $1/9^{th}$ or even $1/10^{th}$ of the total surface area of the layer in which the color region lies. In a different embodiment, at least one color region of the golf ball has a surface area that is at least about $2/5^{th}$ or $3/8^{th}$ or $4/9^{th}$ or even $7/10^{th}$ of the total surface area of the layer in which the color region lies. Also, at least one color region of the golf ball may have a surface area that is at least about the size of one dimple. At least one color region of the golf ball may have a surface area that is at least about the size of one dimple. In a different embodiment, at least one color region of the golf ball may have a surface area that is at least about the size of two dimples. At least one color region of an inventive golf ball may even have a surface area that is at least about the size of three or four or five or six or seven or eight or nine or even ten dimples. And embodiments envisioned in which a color region has a depth or thickness that is substantially similar or equal to that of the layer in which the color region lies. Also, embodiments are envisioned in which a color region has a depth or thickness that is less than that of the layer in which the color region lies. And a color region may comprise any color, pigment dye, tint and/or color effect known in the art as long as the color region as a whole substantially contributes to the overall color appearance of the golf ball.

Figure 8A:
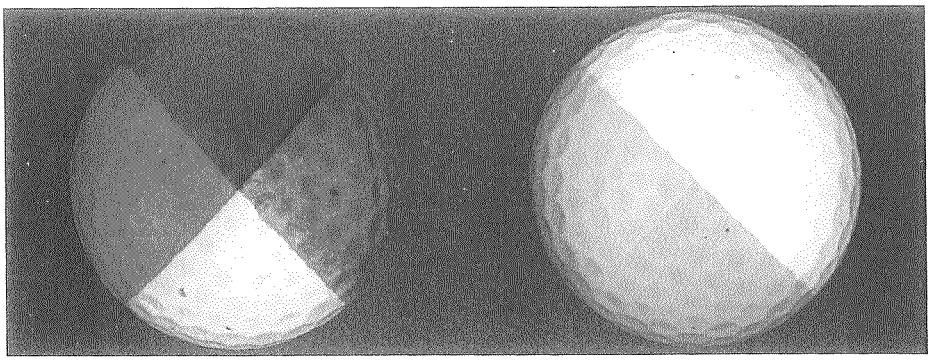
FIGS. 8A and 8B are photographs of golf balls according to several embodiments of the invention.
Figure 8B:
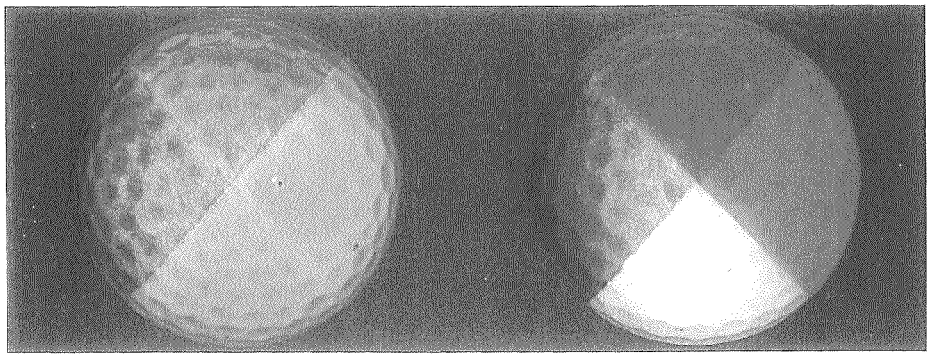

The file of this patent contains FIGS. 8A and 8B executed in color. Accordingly, copies of this patent with color drawings will be provided by the Patent and Trademark Office upon request and payment of the necessary fee.

DETAILED DESCRIPTION

The term "overall color appearance", as used herein, refers to the overall color appearance of the golf ball as perceived by the human eye viewing the entire golf ball surface. For example, a golf ball of the invention may have an overall golf ball appearance comprised of three different color regions even though the golf ball's inner layer is comprised of two different color regions and the overlying outer layer is comprised of two additional differently colored regions. Such a golf ball construction is achieved by strategically positioning and/or aligning the outer layer in relation to the inner layer to define an overall color appearance comprised of at least three discrete color regions as disclosed more fully within.

Figure 1A:
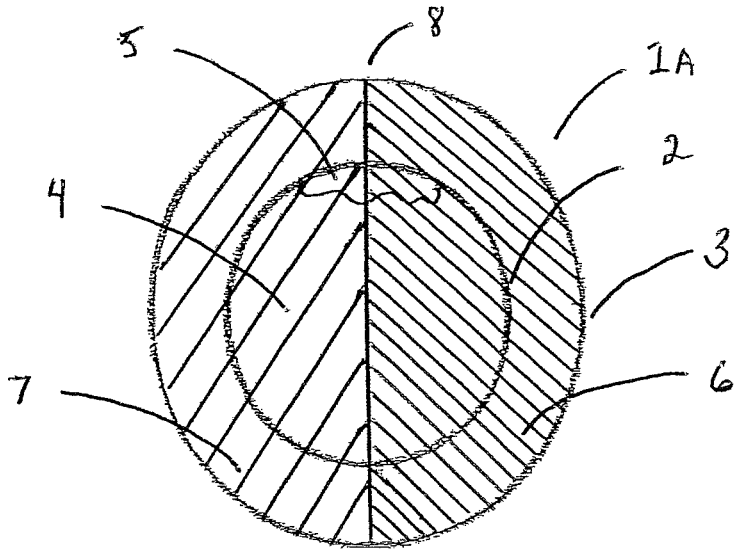
FIGS. 1A and 1B are elevation views of two golf balls of the invention.

Non-limiting examples of the color golf balls of the invention are as follows. Referring to FIG. 1A, in one aspect of the invention, golf ball 1A includes inner layer 2 and outer layer 3, each of which participate in and/or contribute to the golf ball's overall color appearance. Inner layer 2 comprises two different color regions 4 and 5. Color region 4 has a greater surface area than color region 5. Meanwhile, outer layer 3 includes differently color regions 6 and 7 which are disposed about inner layer 2 and bounded by boundary 8. Color regions 6 and 7 are both translucent and outer layer 3 is positioned and aligned about inner layer 2 such that boundary 8 intersects color region 5. Accordingly, the overall color appearance of golf ball 1A is comprised of four different colors.

Figure 1B:
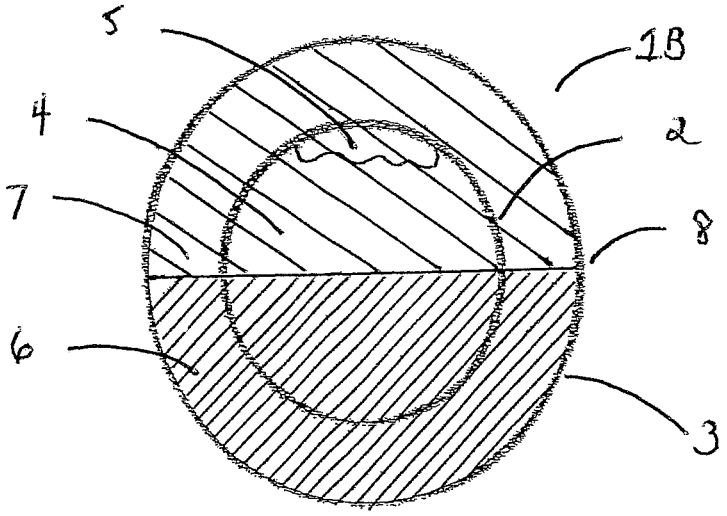

FIG. 1B represents another embodiment of the color golf ball of the invention. Herein, like numbers are used in the figures to identify like elements as between the figures. In FIG. 1B, golf ball 1B includes inner layer 2 and outer layer 3, each of which participate in and/or contribute to the golf ball's overall color appearance. Inner layer 2 comprises two different color regions 4 and 5. Color region 4 has a greater surface area than color region 5. Meanwhile, outer layer 3 includes differently colored color regions 6 and 7 which have the same surface area, are disposed about inner layer 2, and are bounded by boundary 8. Color regions 6 and 7 are both translucent and outer layer 3 is positioned and aligned about inner layer 2 such that boundary 8 does not intersect color region 5. Accordingly, the overall color appearance of golf ball 1B is comprised of three different colors.

Figure 2A:
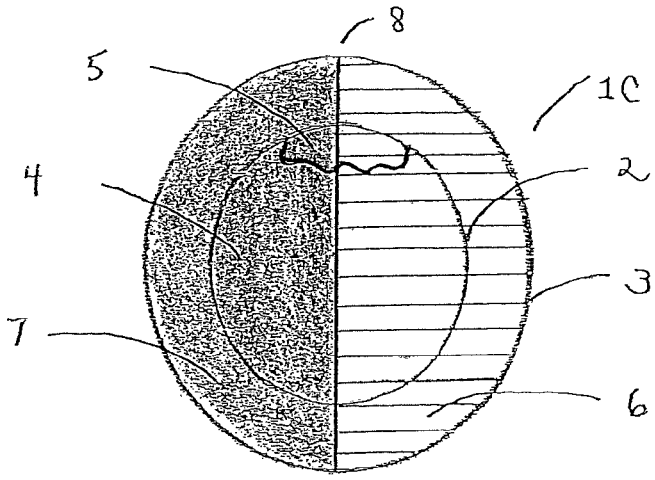
FIGS. 2A, 2B and 2C are elevation views of three golf balls of the invention.

FIG. 2A represents yet another embodiment of the color golf ball of the invention. In FIG. 2A, golf ball 1C includes inner layer 2 and outer layer 3, each of which participate in and/or contribute to the golf ball's overall color appearance. Inner layer 2 comprises two different color regions 4 and 5. Color region 4 has a greater surface area than color region 5. Meanwhile, outer layer 3 includes differently colored color regions 6 and 7 which have the same surface area, are disposed about inner layer 2 and are bounded by boundary 8. Color region 6 is translucent, color region 7 is opaque, and outer layer 3 is positioned and aligned about inner layer 2 such that boundary 8 intersects color region 5. In this embodiment, the overall color appearance of golf ball 1C is comprised of 3 different colors. The golf ball would have a similar overall appearance if color region 6 is opaque and color region 7 is translucent.

Figure 2B:
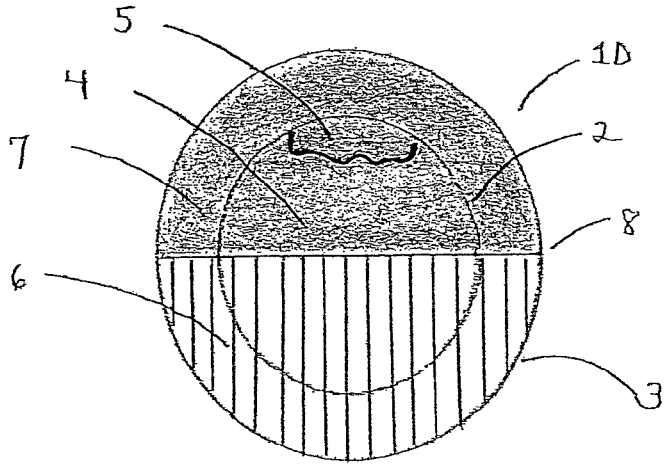
Figure 2C:
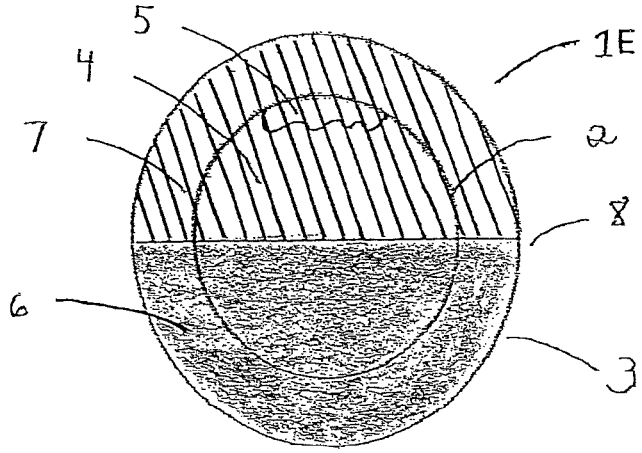

FIG. 2B represents still another embodiment of the color golf ball of the invention. In FIG. 2B, golf ball 1D includes inner layer 2 and outer layer 3, each of which participate in and/or contribute to the golf ball's overall color appearance. Inner layer 2 comprises two different color regions 4 and 5. Color region 4 has a greater surface area than color region 5. Meanwhile, outer layer 3 includes differently colored color regions 6 and 7 which have the same surface area, are disposed about inner layer 2, and are bounded by boundary 8. Color region 6 is translucent, color region 7 is opaque, and outer layer 3 is positioned and aligned about inner layer 2 such that boundary 8 does not intersect color region 5. In this embodiment, the overall color appearance of golf ball 1D is comprised of 2 different colors. This golf ball would not have a similar overall appearance if color region 6 is opaque and color region 7 is translucent—in that case, the color appearance of golf ball 1D would be that of golf ball 1E in FIG. 2C—comprised of 3 different colors.

Figure 3A:
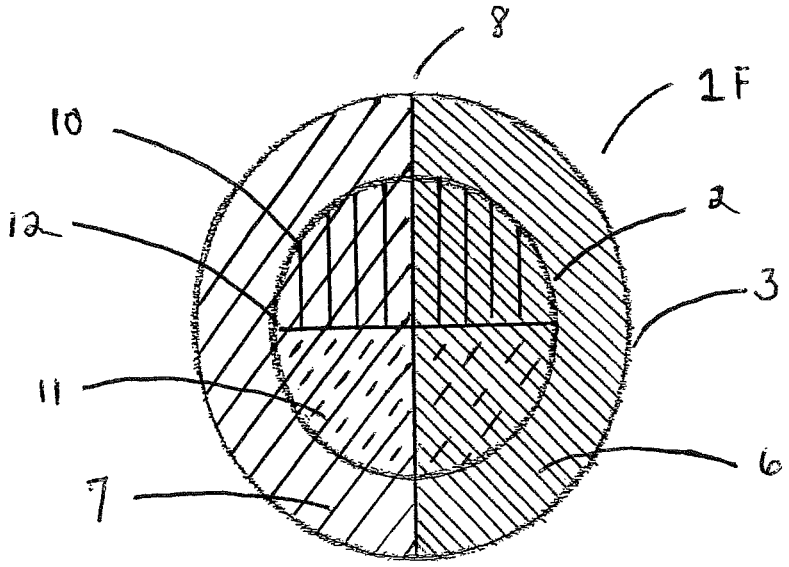
FIGS. 3A and 3B are elevation views of two golf balls of the invention.

FIG. 3A represents a different embodiment of the color golf ball of the invention. In FIG. 3A, golf ball 1F includes inner layer 2 and outer layer 3, each of which participate in and/or contribute to the golf ball's overall color appearance. Inner layer 2 includes differently colored color regions 10 and 11 which are bounded by boundary 12. The surface areas of color regions 10 and 11 are equivalent. Meanwhile, outer layer 3 includes differently colored color regions 6 and 7 which have the same surface area, are disposed about inner layer 2, and are bounded by boundary 8. Color regions 6 and 7 are both translucent and outer layer 3 is positioned and aligned about inner layer 2 such that boundary 8 is perpendicular/orthogonal to boundary 12. Accordingly, the overall color appearance of golf ball 1F is comprised of four different colors.

Figure 3B:
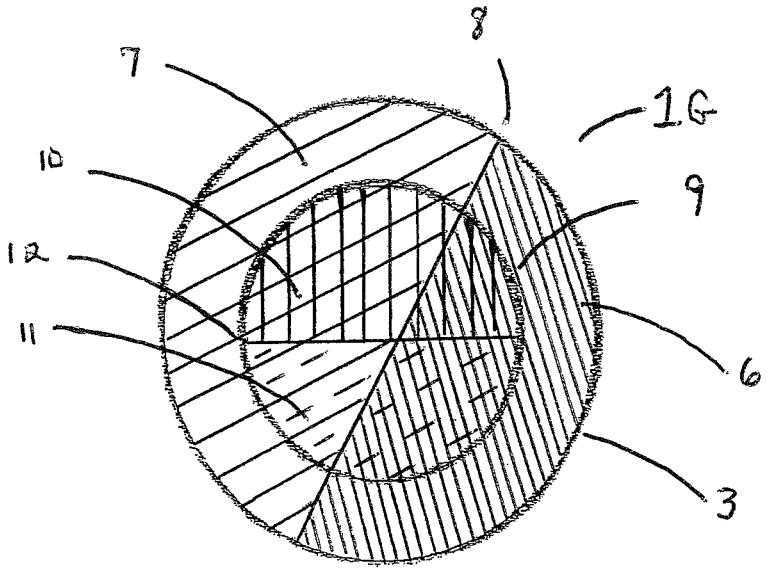

FIG. 3B represents an alternative embodiment of the color golf ball of the invention. In FIG. 3B, golf ball 1G includes inner layer 9 and outer layer 3, each of which participate in and/or contribute to the golf ball's overall color appearance. Inner layer 9 includes differently colored color regions 10 and 11 which are bounded by boundary 12. The surface areas of colored regions 10 and 11 are equivalent. Meanwhile, outer layer 3 includes differently colored color regions 6 and 7 which have the same surface area, are disposed about inner layer 9, and are bounded by boundary 8. Color regions 6 and 7 are both translucent and outer layer 3 is positioned and aligned about inner layer 9 such that boundary 8 is not perpendicular/orthogonal to boundary 12. Nevertheless, the overall color appearance of golf ball 1G is comprised of four different colors.

Figure 4A:
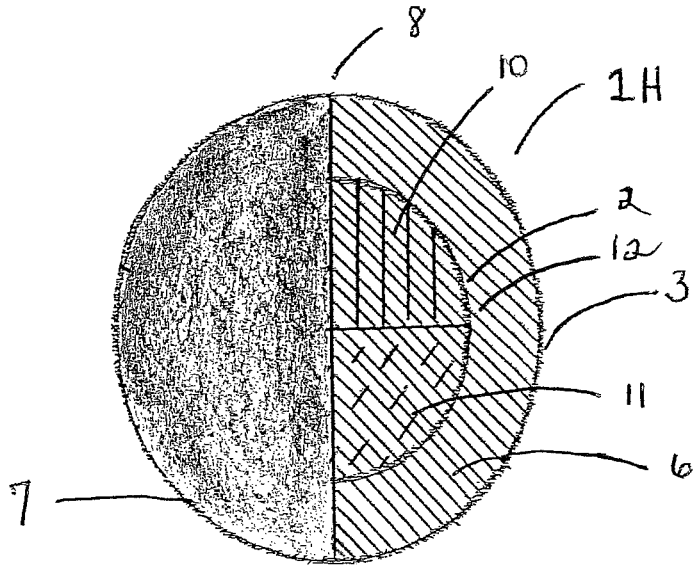
FIGS. 4A and 4B are elevation views of two golf balls of the invention.

In FIG. 4A, golf ball 1H includes inner layer 9 and outer layer 3, each of which participate in and/or contribute to the golf ball's overall color appearance. Inner layer 9 includes differently colored color regions 10 and 11 which are bounded by boundary 12. The surface areas of color regions 10 and 11 are equivalent. Meanwhile, outer layer 3 includes differently colored color regions 6 and 7 which are disposed about inner layer 9 and bounded by boundary 8. Color region 6 is translucent, color region 7 is opaque, and outer layer 3 is positioned and aligned about inner layer 9 such that boundary 8 is perpendicular/orthogonal to boundary 12. Accordingly, the overall color appearance of golf ball 1H is comprised of three different colors. This golf ball would have an equal but opposite overall appearance if color region 6 is opaque and color region 7 is translucent.

Figure 4B:
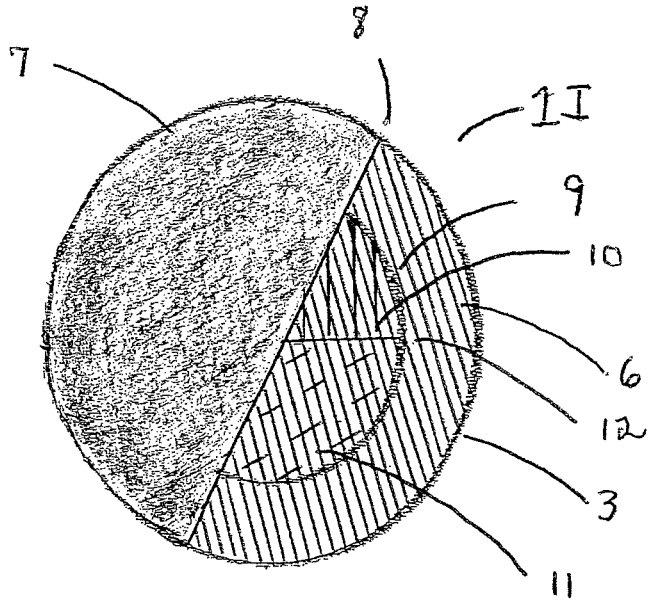

In FIG. 4B, golf ball 1I includes inner layer 9 and outer layer 3, each of which participate in and/or contribute to the golf ball's overall color appearance. Inner layer 9 includes differently colored color regions 10 and 11 which are bounded by boundary 12. The surface areas of color regions 10 and 11 are equivalent. Meanwhile, outer layer 3 includes differently colored color regions 6 and 7 which are disposed about inner layer 9 and bounded by boundary 8. Color region 6 is translucent, color region 7 is opaque, and outer layer 3 is positioned and aligned about inner layer 9 such that boundary 8 is not perpendicular/orthogonal to boundary 12. Nevertheless, the overall color appearance of golf ball 1I is comprised of three different colors. Alternatively, color region 6 being opaque and color region 7 being translucent would result in a rotation transformation of the overall color appearance which resulted from color region 6 being translucent and color region 7 being opaque.

Figure 5A:
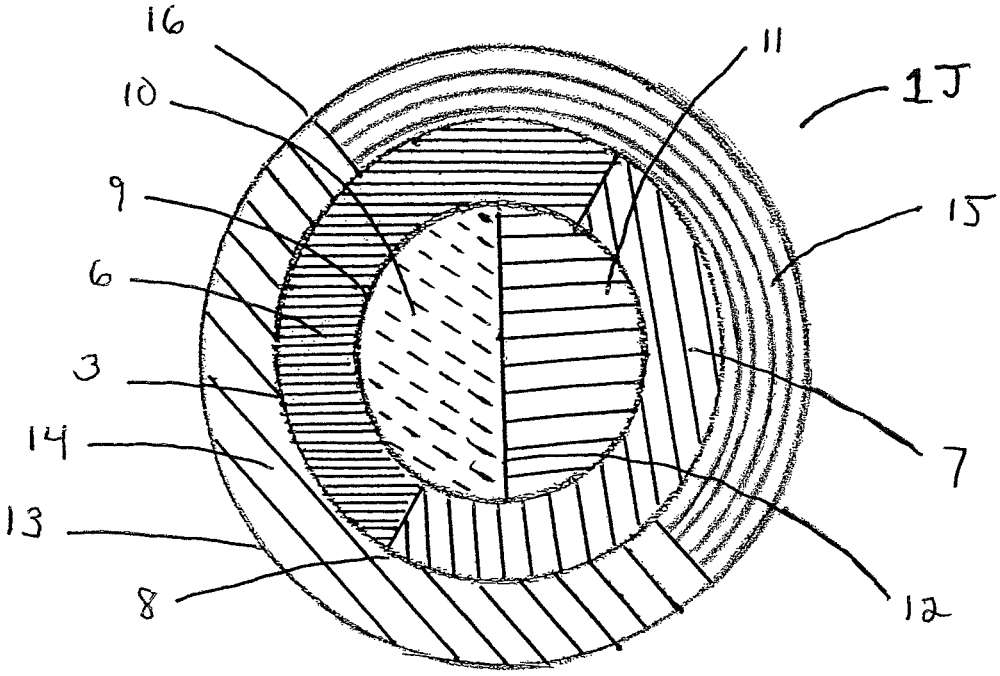
FIGS. 5A and 5B are views of two golf balls of the invention, the outer layer and outermost layer being cross-sectioned.

A golf ball of the invention may also include three or more layers which participate/contribute to the overall color appearance. For example, golf ball 1J of FIG. 5A comprises inner layer 9, outer layer 3, and outermost layer 13, each of which participate in and/or contribute to the golf ball's overall color appearance. Inner layer 9 includes differently colored color regions 10 and 11 which are bounded by boundary 12. The surface areas of color regions 10 and 11 are equivalent. Meanwhile, outer layer 3 includes differently colored color regions 6 and 7 which are disposed about inner layer 9 and bounded by boundary 8. Color regions 6 and 7 are both translucent and outer layer 3 is positioned and aligned about inner layer 9 such that boundary 8 is not perpendicular/orthogonal to boundary 12. Then, outermost layer 13 includes differently colored color regions 14 and 15 which are bounded by boundary 16. Color regions 6, 7, 14 and 15 are both translucent and outermost layer 13 is positioned and aligned about outer layer 3 such that boundary 16 is not perpendicular/orthogonal to either of boundaries 12 or 8. Accordingly, the overall color appearance of golf ball 1I is comprised of six different colors.

Figure 5B:
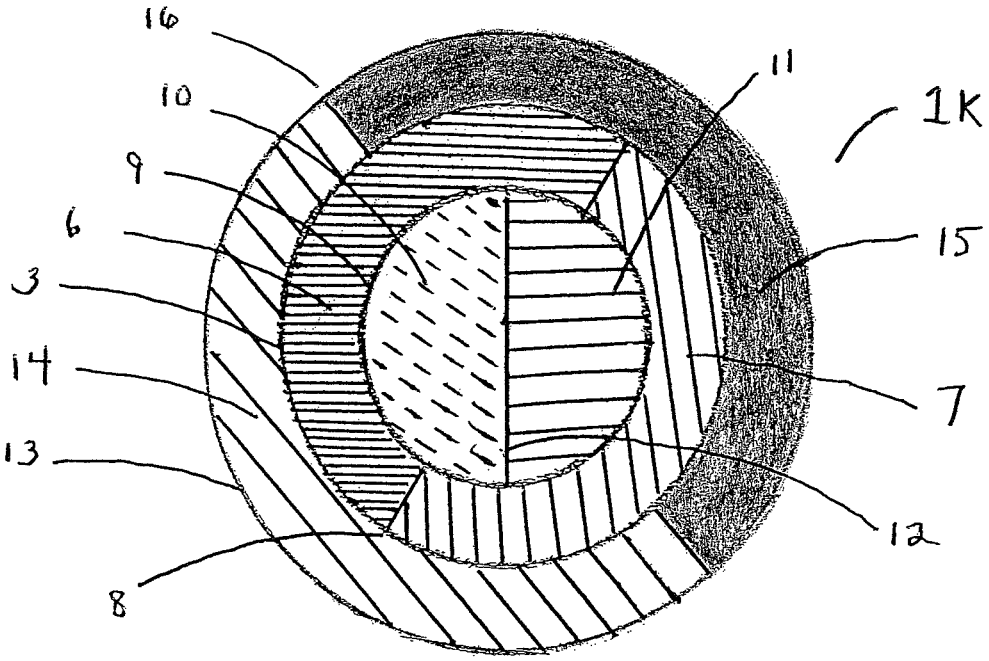

In FIG. 5B, golf ball 1K includes inner layer 9 and outer layer 3, and outermost layer 13, each of which participate in and/or contribute to the golf ball's overall color appearance. Inner layer 9 includes differently colored color regions 10 and 11 which are bounded by boundary 12. The surface areas of color regions 10 and 11 are equivalent. Meanwhile, outer layer 3 includes differently colored color regions 6 and 7 which are disposed about inner layer 9 and bounded by boundary 8. Color regions 6 and 7 are both translucent and outer layer 3 is positioned and aligned about inner layer 9 such that boundary 8 is not perpendicular/orthogonal to boundary 12. Then, outermost layer 13 includes differently colored color regions 14 and 15 which are bounded by boundary 16. Color regions 14 is translucent, color region 15 is opaque, and outermost layer 13 is positioned and aligned about outer layer 3 such that boundary 16 is not perpendicular/orthogonal to either of boundaries 12 or 8. Accordingly, the overall color appearance of golf ball 1J is comprised of 4 different colors.

Further, golf ball 1K of FIG. 5B would have an overall color appearance of five colors if one of color regions 6 and 7 are opaque. Alternatively, Golf ball 1K would also have an overall color appearance of three colors if each of color regions 6, 7, 14 and 15 are opaque.

Figure 6A:
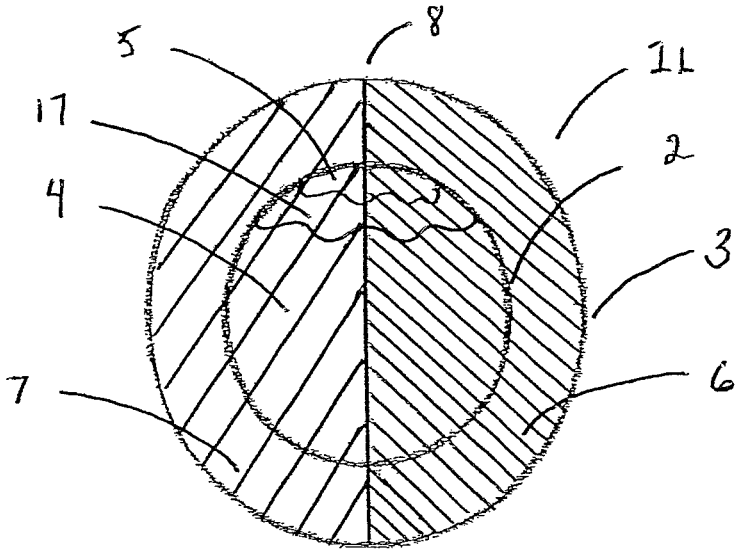
FIGS. 6A and 6B are elevation views of two golf balls of the invention.

Embodiments are also envisioned in which the inner layer 2 of FIGS. 1-5 is comprised of greater than two differently colored color regions. For example, in FIG. 6A, golf ball 1L includes inner layer 2 and outer layer 3, each of which participate in and/or contribute to the golf ball's overall color appearance. Inner layer 2 comprises three differently colored color regions 4, 5 and 17. Color region 4 has a greater surface area than color regions 5 and 17, but color regions 5 and 17 do not necessarily have equivalent surface areas. Meanwhile, outer layer 3 includes differently colored color regions 6 and 7, which are disposed about inner layer 2 and bounded by boundary 8. Color regions 6 and 7 are both translucent and outer layer 3 is positioned and aligned about inner layer 2 such that boundary 8 intersects color regions 5 and 17. Accordingly, the overall color appearance of golf ball 1L is comprised of six different colors. Where color region 6 or 7 is opaque, the overall color appearance of golf ball 1L is comprised of four different colors.

Figure 6B:
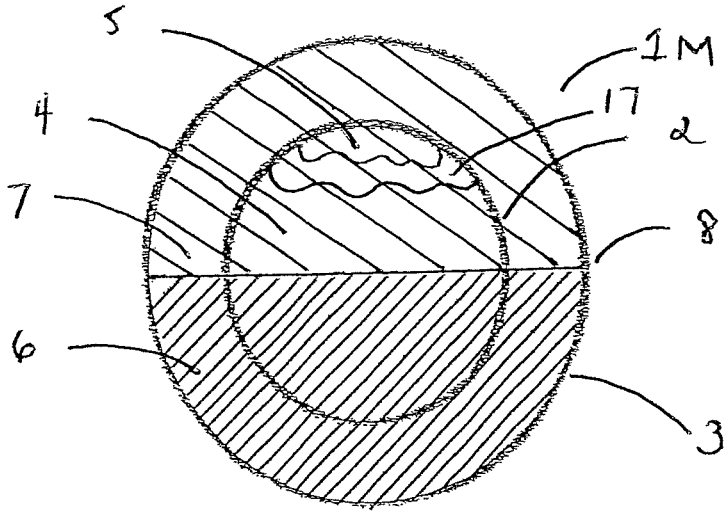

In FIG. 6B, in an embodiment wherein boundary 8 does not intersect color region 5 or 17 and outer layer color regions 6 and 7 are translucent, the overall color appearance of golf ball 1M would be comprised of four different colors. And if color region 6 is opaque, then the overall color appearance of golf ball 1M would still be comprised of four different colors. But if color region 7 is opaque, then the overall color appearance of golf ball 1L would be comprised of two different colors.

Figure 7A:
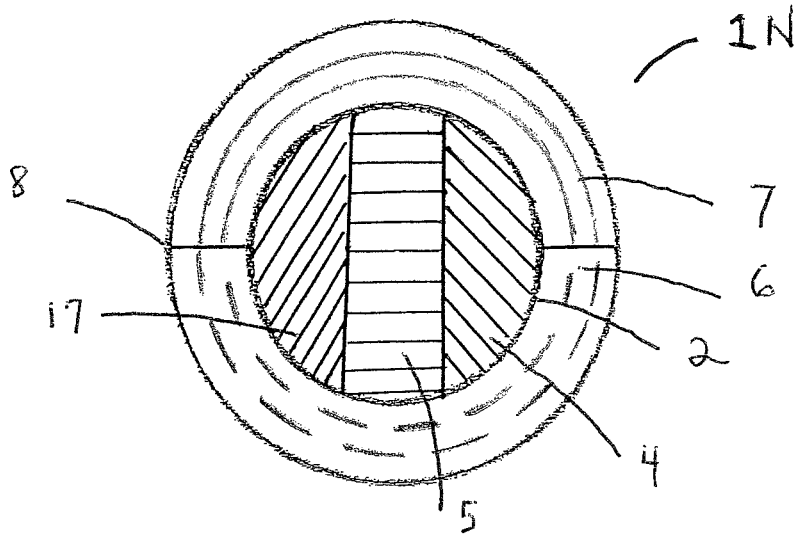
FIGS. 7A and 7B are views of two golf balls of the invention, the outer layer being cross-sectioned.

In FIG. 7A, golf ball 1N includes inner layer 2 and outer layer 3, each of which participate in and/or contribute to the golf ball's overall color appearance. Inner layer 2 comprises three differently colored color regions 4, 5 and 17. Meanwhile, outer layer 3 includes differently colored color regions 6 and 7, which are disposed about inner layer 2 and bounded by boundary 8. Color regions 6 and 7 are both translucent and outer layer 3 is positioned and aligned about inner layer 2 such that boundary 8 intersects all of color regions 4, 5 and 17. Accordingly, the overall color appearance of golf ball 1N is comprised of six different colors. Where either color region 6 or color region 7 is opaque, the overall color appearance of golf ball 1N is comprised of four different colors.

Figure 7B:
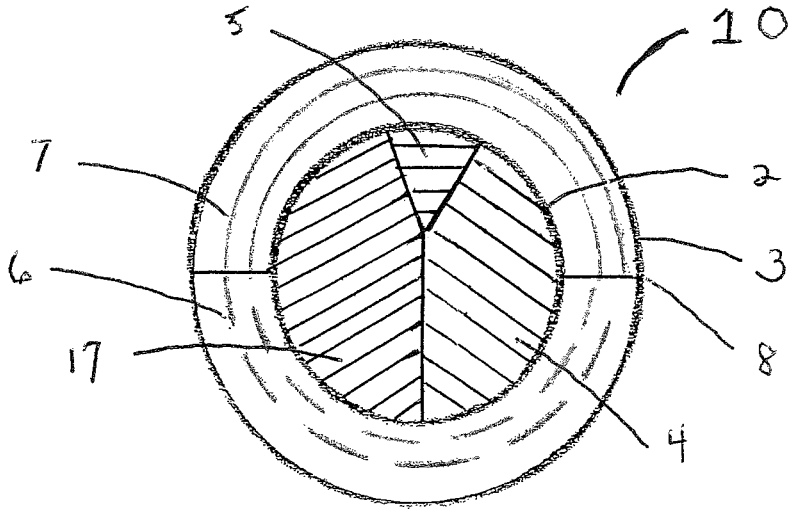

In FIG. 7B, golf ball 10 includes inner layer 2 and outer layer 3, each of which participate in and/or contribute to the golf ball's overall color appearance. Inner layer 2 comprises three differently colored color regions 4, 5 and 17. Meanwhile, outer layer 3 includes differently colored color regions 6 and 7, which are disposed about inner layer 2 and bounded by boundary 8. Color regions 6 and 7 are both translucent and outer layer 3 is positioned and aligned about inner layer 2 such that boundary 8 intersects two of color regions 4, 5 and 17. Accordingly, the overall color appearance of golf ball 10 is comprised of five different colors. Where either color region 6 or color region 7 is opaque, the overall color appearance of golf ball 1 is comprised of four different colors. Of course, inner layer 2 may alternatively be comprised of greater than three differently colored core regions as well.

And as the number of additional differently color regions such as 5 and 17 in inner layer 2 increases, the surface area of color region 4 will necessarily be lower. Thus, an embodiment is envisioned in which the surface area of color region 4 is substantially equivalent to at least one of the other colored regions such as 5 or 17 or even substantially equivalent to the sum of the surface areas of the other colored regions.

Herein, an inner layer may comprise, for example, a core surface, an outer core layer, an intermediate layer, a mantle layer or an inner cover layer. Meanwhile, an outer layer may comprise for example, an outer core layer (where the cover is transparent), an inner cover layer (where, for example, the outer cover layer is transparent) or an outer cover layer.

FIGS. 8A and 8B are photographs of actual golf balls demonstrating one aspect of the invention as depicted in FIG. 3A.

Figure 9A:
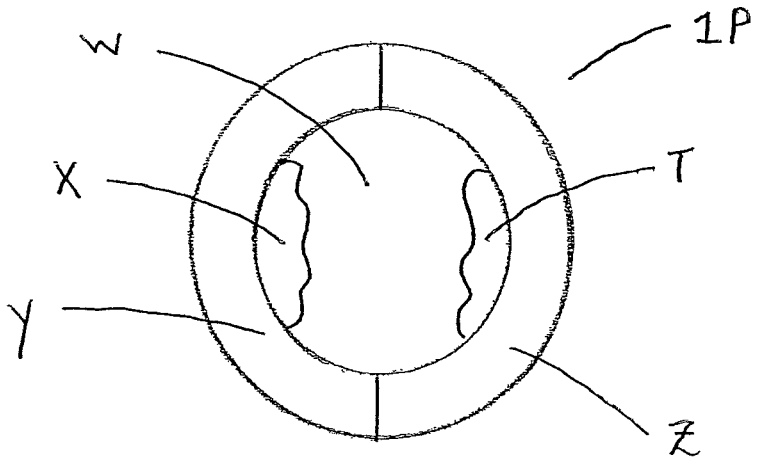
FIGS. 9A, 9B and 9C are views of three golf balls of the invention, the outer layer being cross-sectioned.
Figure 9B:
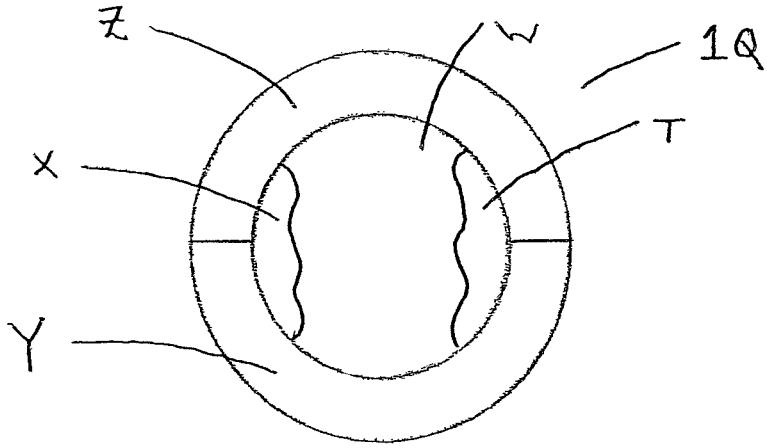
Figure 9C:
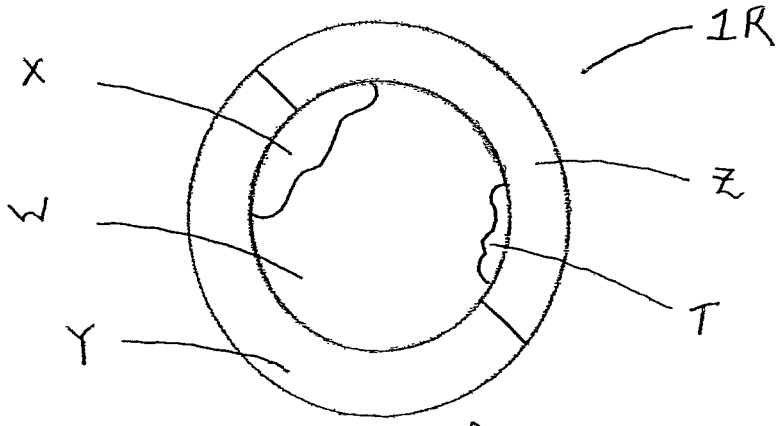

FIGS. 9A, 9B and 9C disclose three other embodiments for the golf ball of the invention. In FIG. 9A, golf ball 1P has color regions X, W and T, comprising an inner layer, and color regions Y and Z, comprising an outer layer. The translucent outer layer is positioned and aligned about the inner layer as shown to form a golf ball having an overall color appearance of four colors. In FIG. 9B, golf ball 1Q has color regions X, W and T, comprising an inner layer, and color regions Y and Z, comprising an outer layer. The translucent outer layer is positioned and aligned about the inner layer as shown to form a golf ball having an overall color appearance of six colors. In FIG. 9C, golf ball 1R has color regions X, W and T, comprising an inner layer, and color regions Y and Z, comprising an outer layer. The translucent outer layer is positioned and aligned about the inner layer as shown to form a golf ball having an overall color appearance of five colors.

Figure 10A:
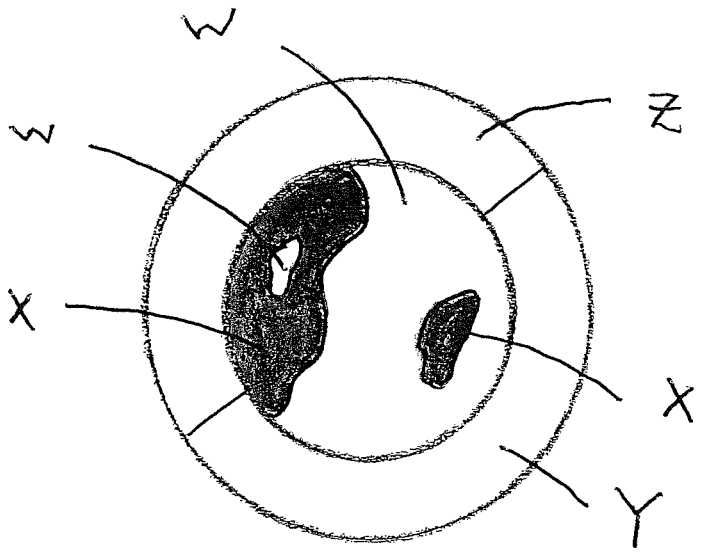
FIGS. 10A and 10B are views of two golf balls of the invention, the outer layer being cross-sectioned.
Figure 10B:
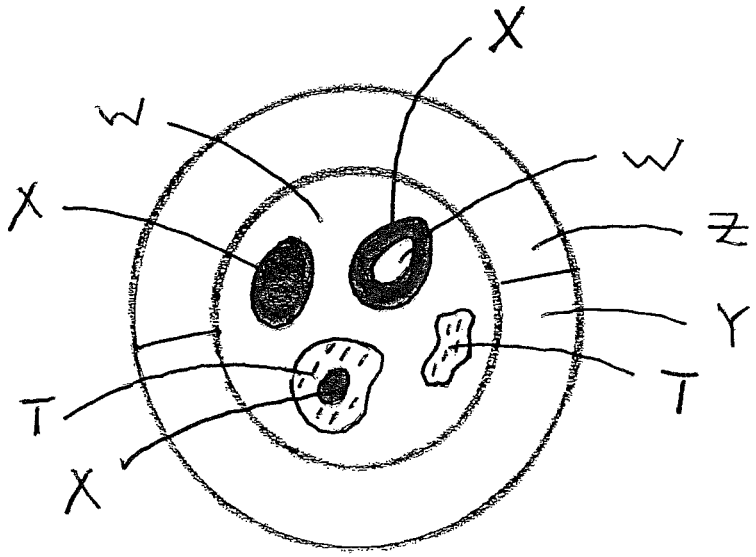

FIGS. 10A and 10B depict two examples of the many possible inner layer color region arrangements for the golf ball of the invention.

Each of the examples disclosed herein, novel golf balls having unique and perceptively pleasing color combinations are achieved by positioning and aligning the outer layer about the inner layer, the inner and outer layer each comprising multiple regions of color, each of which substantially contribute to the golf ball's overall color appearance.

The cores in golf balls of this invention may be solid, semi-solid, hollow, fluid-filled, or powder-filled. Typically, the cores are solid and made from rubber compositions containing at least a base rubber, free-radical initiator agent, cross-linking co-agent, and fillers. Golf balls having various constructions may be made in accordance with this invention. For example, golf balls having three-piece, four-piece, and five-piece constructions with dual or three-layered cores and cover materials may be made The term, "layer" as used herein means generally any spherical portion of the golf ball. More particularly, in one version, a three-piece golf ball comprising a core and a "dual-cover" is made. In another version, a four-piece golf ball comprising a dual-core and "dual-cover" is made. The dual-core includes an inner core (center) and surrounding outer core layer. The dual-cover includes inner cover and outer cover layers. In yet another construction, a five-piece golf ball having a dual-core, intermediate layer, and dual-cover is made. In still another embodiment, a four piece golf ball comprises a core and a three layer cover.

As used herein, the term, "intermediate layer" means a layer of the ball disposed between the core and cover. The intermediate layer may be considered an outer core layer, or inner cover layer, or any other layer disposed between the inner core and outer cover of the ball. The intermediate layer also may be referred to as a casing or mantle layer. The diameter and thickness of the different layers along with properties such as hardness and compression may vary depending upon the construction and desired playing performance properties of the golf ball and as specified herein.

The inner core of the golf ball may comprise a polybutadiene rubber material. In one embodiment, the ball contains a single core formed of the polybutadiene rubber composition. In a second embodiment, the ball contains a dual-core comprising an inner core (center) and surrounding outer core layer. In yet another version, the golf ball contains a multi-layered core comprising an inner core, intermediate core layer, and outer core layer.

In general, polybutadiene is a homopolymer of 1,3-butadiene. The double bonds in the 1,3-butadiene monomer are attacked by catalysts to grow the polymer chain and form a polybutadiene polymer having a desired molecular weight. Any suitable catalyst may be used to synthesize the polybutadiene rubber depending upon the desired properties. Normally, a transition metal complex (for example, neodymium, nickel, or cobalt) or an alkyl metal such as alkyllithium is used as a catalyst. Other catalysts include, but are not limited to, aluminum, boron, lithium, titanium, and combinations thereof. The catalysts produce polybutadiene rubbers having different chemical structures. In a cis-bond configuration, the main internal polymer chain of the polybutadiene appears on the same side of the carbon-carbon double bond contained in the polybutadiene. In a trans-bond configuration, the main internal polymer chain is on opposite sides of the internal carbon-carbon double bond in the polybutadiene. The polybutadiene rubber can have various combinations of cis- and trans-bond structures. A preferred polybutadiene rubber has a 1,4 cis-bond content of at least 40%, preferably greater than 80%, and more preferably greater than 90%. In general, polybutadiene rubbers having a high 1,4 cis-bond content have high tensile strength. The polybutadiene rubber may have a relatively high or low Mooney viscosity.

Examples of commercially available polybutadiene rubbers that can be used in accordance with this invention, include, but are not limited to, BR 01 and BR 1220, available from BST Elastomers of Bangkok, Thailand; SE BR 1220LA and SE BR1203, available from DOW Chemical Co of Midland, Mich.; BUDENE 1207, 1207s, 1208, and 1280 available from Goodyear, Inc of Akron, Ohio; BR 01, 51 and 730, available from Japan Synthetic Rubber (JSR) of Tokyo, Japan; BUNA CB 21, CB 22, CB 23, CB 24, CB 25, CB 29 MES, CB 60, CB Nd 60, CB 55 NF, CB 70 B, CB KA 8967, and CB 1221, available from Lanxess Corp. of Pittsburgh. Pa.; BR1208, available from LG Chemical of Seoul, South Korea; UBEPOL BR130B, BR150, BR150B, BR150L, BR230, BR360L, BR710, and VCR617, available from UBE Industries, Ltd. of Tokyo, Japan; EUROPRENE NEOCIS BR 60, INTENE 60 AF and P30AF, and EUROPRENE BR HV80, available from Polimeri Europa of Rome, Italy; AFDENE 50 and NEODENE BR40, BR45, BR50 and BR60, available from Karbochem (PTY) Ltd. of Bruma, South Africa; KBR 01, NdBr 40, NdBR-45, NdBr 60, KBR 710S, KBR 710H, and KBR 750, available from Kumho Petrochemical Co., Ltd. Of Seoul, South Korea; DIENE 55NF, 70AC, and 320 AC, available from Firestone Polymers of Akron, Ohio; and PBR-Nd Group II and Group III, available from Nizhnekamskneftekhim, Inc. of Nizhnekamsk, Tartarstan Republic.

Suitable polybutadiene rubbers for blending with the base rubber may include BUNA® CB22, BUNA® CB23 and BUNA® CB24, BUNA® 1203G1, 1220, 1221, and BUNA®CBNd-40, commercially available from LANXESS Corporation; BSTE BR-1220 available from BST Elastomers Co. LTD; UBEPOL® 360L and UBEPOL® 150L and UBEPOL-BR rubbers, commercially available from UBE Industries, Ltd. of Tokyo, Japan; Budene 1207, 1208 and 1280, commercially available from Goodyear of Akron, Ohio; SE BR-1220, commercially available from Dow Chemical Company; Europrene® NEOCIS® BR 40 and BR 60, commercially available from Polimeri Europa; and BR 01, BR 730, BR 735, BR 11, and BR 51, commercially available from Japan Synthetic Rubber Co., Ltd; and KARBOCHEM® Neodene 40, 45, and 60, commercially available from Karbochem.

The base rubber may further include polyisoprene rubber, natural rubber, ethylene-propylene rubber, ethylene-propylene diene rubber, styrene-butadiene rubber, and combinations of two or more thereof. Another preferred base rubber is polybutadiene optionally mixed with one or more elastomers such as polyisoprene rubber, natural rubber, ethylene propylene rubber, ethylene propylene diene rubber, styrene-butadiene rubber, polystyrene elastomers, polyethylene elastomers, polyurethane elastomers, polyurea elastomers, acrylate rubbers, polyoctenamers, metallocene-catalyzed elastomers, and plastomers. As discussed further below, highly neutralized acid copolymers (HNPs), as known in the art, also can be used to form the core layer as part of the blend. Such compositions will provide increased flexural modulus and toughness thereby improving the golf ball's performance including its impact durability.

The base rubber typically is mixed with at least one reactive cross-linking co-agent to enhance the hardness of the rubber composition. Suitable co-agents include, but are not limited to, unsaturated carboxylic acids and unsaturated vinyl compounds. A preferred unsaturated vinyl compound is trimethylolpropane trimethacrylate. The rubber composition is cured using a conventional curing process. Suitable curing processes include, for example, peroxide curing, sulfur curing, high-energy radiation, and combinations thereof. In one embodiment, the base rubber is peroxide cured. Organic peroxides suitable as free-radical initiators include, for example, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; and combinations thereof. Cross-linking agents are used to cross-link at least a portion of the polymer chains in the composition. Suitable cross-linking agents include, for example, metal salts of unsaturated carboxylic acids having from 3 to 8 carbon atoms; unsaturated vinyl compounds and polyfunctional monomers (for example, trimethylolpropane trimethacrylate); phenylene bismaleimide; and combinations thereof. In a particular embodiment, the cross-linking agent is selected from zinc salts of acrylates, diacrylates, methacrylates, and dimethacrylates. In another particular embodiment, the cross-linking agent is zinc diacrylate ("ZDA"). Commercially available zinc diacrylates include those selected from Cray Valley Resource Innovations Inc. Other elastomers known in the art may also be added, such as other polybutadiene rubbers, natural rubber, styrene butadiene rubber, and/or isoprene rubber in order to further modify the properties of the core. When a mixture of elastomers is used, the amounts of other constituents in the core composition are typically based on 100 parts by weight of the total elastomer mixture.

Thermoplastic elastomers (TPE) may also be used to modify the properties of the core layers, or the uncured core layer stock by blending with the uncured rubber. These TPEs include natural or synthetic balata, or high trans-polyisoprene, high trans-polybutadiene, or any styrenic block copolymer, such as styrene ethylene butadiene styrene, styrene-isoprene-styrene, etc., a metallocene or other single-site catalyzed polyolefin such as ethylene-octene, or ethylene-butene, or thermoplastic polyurethanes (TPU), including copolymers, e.g. with silicone. Other suitable TPEs for blending with the thermoset rubbers of the present invention include PEBAX®, which is believed to comprise polyether amide copolymers, HYTREL®, which is believed to comprise polyether ester copolymers, thermoplastic urethane, and KRATON®, which is believed to comprise styrenic block copolymers elastomers. Any of the TPEs or TPUs above may also contain functionality suitable for grafting, including maleic acid or maleic anhydride. Any of the Thermoplastic Vulcanized Rubbers (TPV) such as Santoprene® or Vibram® or ETPV® can be used along with a present invention. In one embodiment, the TPV has a thermoplastic as a continuous phase and a cross-linked rubber particulate as a dispersed (or discontinuous) phase. In another embodiment, the TPV has a cross-linked phase as a continuous phase and a thermoplastic as a dispersed (or discontinuous) phase to provide reduced loss in elasticity in order to improve the resiliency of the golf ball.

The rubber compositions also may contain "soft and fast" agents such as a halogenated organosulfur, organic disulfide, or inorganic disulfide compounds. Particularly suitable halogenated organosulfur compounds include, but are not limited to, halogenated thiophenols. Preferred organic sulfur compounds include, but not limited to, pentachlorothiophenol ("PCTP") and a salt of PCTP. A preferred salt of PCTP is ZnPCTP. A suitable PCTP is sold by the Struktol Company (Stow, Ohio) under the tradename, A95. ZnPCTP is commercially available from EchinaChem (San Francisco, Calif.). These compounds also may function as cis-to-trans catalysts to convert some cis bonds in the polybutadiene to trans bonds. Antioxidants also may be added to the rubber compositions to prevent the breakdown of the elastomers. Other ingredients such as accelerators (for example, tetra methylthiuram), processing aids, dyes and pigments, wetting agents, surfactants, plasticizers, as well as other additives known in the art may be added to the rubber composition.

The core may be formed by mixing and forming the rubber composition using conventional techniques. These cores can be used to make finished golf balls by surrounding the core with outer core layer(s), intermediate layer(s), and/or cover materials as discussed further below. In another embodiment, the cores can be formed using highly neutralized polymer (HNP) compositions as disclosed in U.S. Pat. Nos. 6,756,436, 7,030,192, 7,402,629, and 7,517,289. The cores from the highly neutralized polymer compositions can be further cross-linked using any free-radical initiation sources including radiation sources such as gamma or electron beam as well as chemical sources such as peroxides and the like.

Golf balls made in accordance with this invention can be of any size, although the USGA requires that golf balls used in competition have a diameter of at least 1.68 inches and a weight of no greater than 1.62 ounces. For play outside of USGA competition, the golf balls can have smaller diameters and be heavier.

A wide variety of thermoplastic or thermosetting materials can be employed in forming the core, cover layers, or both. These materials include for example, olefin-based copolymer ionomer resins (for example, Surlyn® ionomer resins and DuPont® HPF 1000 and HPF 2000, as well as blends of Surlyn®7940/Surlyn®8940 or Surlyn®8150/Surlyn®9150 commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, for example, poly (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; copolymers of ethylene and vinyl acetates; copolymers of ethylene and methyl acrylates; polyvinyl chloride resins; polyamides, poly(amide-ester) elastomers, and graft copolymers of ionomer and polyamide including, for example, Pebax® thermoplastic polyether block amides, commercially available from Arkema Inc; cross-linked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof.

In fact, any of the core, intermediate layer and/or cover layers may include the following materials:

(1) Polyurethanes, such as those prepared from polyols and diisocyanates or polyisocyanates and/or their prepolymers;

(2) Polyureas; and (3) Polyurethane-urea hybrids, blends or copolymers comprising urethane and urea segments.

Polyurethanes and polyureas may constitute either thermoset or thermoplastic compositions, depending on the type of crosslinking bond that is created during formation of the composition. When a polyurethane or polyurea prepolymer is cross linked with a polyfunctional curing agent, covalent bonding occurs, resulting in a thermoset composition. In contrast, polyurethanes and polyureas will be thermoplastic where the crosslinking is due, for example, to hydrogen bonding, resulting in weaker bonds which may be broken upon heating the composition. This distinction explains why thermoset materials generally may not be recycled or reformed into a different shape by heating (at least not easily), whereas thermoplastic materials may so be. The process for manufacturing a golf ball according to the invention is particularly well-suited for forming golf balls having a combination of a very thin, thermoplastic outer cover and a thermoset inner cover having a thickness greater than that of the outer cover layer, providing both COR stability and playability.

Suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Patent Application Publication No. 2005/0176523, which is incorporated by reference in its entirety.

Any polyisocyanate available to one of ordinary skill in the art is suitable for use according to the invention. Exemplary polyisocyanates include, but are not limited to, 4,4'-diphenylmethane diisocyanate (MDI); polymeric MDI; carbodiimide-modified liquid MDI; 4,4'-dicyclohexylmethane diisocyanate ($H_{12}$MDI); p-phenylene diisocyanate (PPDI); m-phenylene diisocyanate (MPDI); toluene diisocyanate (TDI); 3,3'-dimethyl-4,4'-biphenylene diisocyanate; isophoronediisocyanate; 1,6-hexamethylene diisocyanate (HDI); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term MDI includes 4,4'-diphenylmethane diisocyanate, polymeric MDI, carbodiimide-modified liquid MDI, and mixtures thereof. Additionally, the prepolymers synthesized from these diisocyanates may be "low free monomer," understood by one of ordinary skill in the art to have lower levels of "free" isocyanate monomers, typically less than about 0.1% free isocyanate. Examples of "low free monomer" prepolymers include, but are not limited to Low Free Monomer MDI prepolymers, Low Free Monomer TDI prepolymers, and Low Free Monomer PPDI prepolymers.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl) ether; and mixtures thereof. Preferred hydroxy-terminated curatives include 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In one embodiment of the present invention, saturated polyurethanes are used to form one or more of the cover layers.

Additionally, polyurethane can be replaced with or blended with a polyurea material. Polyureas are distinctly different from polyurethane compositions, giving better shear resistance.

The polyether amine may be blended with additional polyols to formulate copolymers that are reacted with excess isocyanate to form the polyurea prepolymer. In one embodiment, less than about 30 percent polyol by weight of the copolymer is blended with the saturated polyether amine. In another embodiment, less than about 20 percent polyol by weight of the copolymer, preferably less than about 15 percent by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking a polyurea prepolymer with a single curing agent or a blend of curing agents. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; 3,5-diethyltoluene-2,4-diamine; triethanolamine; monoisopropanolamine, diisopropanolamine; isophoronediamine; 4,4'-methylenebis-(2-chloroaniline); 3,5-dimethylthio-2,4-toluenediamine; 3,5-dimethylthio-2,6-toluenediamine; 3,5-diethylthio-2,4-toluenediamine; 3,5-diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis (2-hydroxypropyl)ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); meta-phenylenediamine; paraphenylenediamine; and mixtures thereof. In one embodiment, the amine-terminated curing agent is 4,4'-bis-(sec-butylamino)-dicyclohexylmethane.

Suitable saturated amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 4,4'-methylenebis-(2,6-diethylaminocyclohexane; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; triisopropanolamine; and mixtures thereof. In addition, any of the polyether amines listed above may be used as curing agents to react with the polyurea prepolymers.

Alternatively, other suitable polymers include partially or fully neutralized ionomer, metallocene, or other single-site catalyzed polymer, polyester, polyamide, non-ionomeric thermoplastic elastomer, copolyether-esters, copolyether-amides, polycarbonate, polybutadiene, polyisoprene, polystryrene block copolymers (such as styrene-butadiene-styrene), styrene-ethylene-propylene-styrene, styrene-ethylene-butylene-styrene, and the like, and blends thereof.

Intermediate layers and/or cover layers may also be formed from ionomeric polymers or ionomer blends such as Surlyn 7940/8940 or Surlyn 8150/9150 or from highly-neutralized ionomers (HNP).

In one embodiment, at least one intermediate layer of the golf ball is formed from an HNP material or a blend of HNP materials. The acid moieties of the HNP's, typically ethylene-based ionomers, are preferably neutralized greater than about 70%, more preferably greater than about 90%, and most preferably at least about 100% with a cation source. Suitable cation sources include metal cations and salts thereof, organic amine compounds, ammonium, and combinations thereof. The HNP's can be also be blended with a second polymer component, which, if containing an acid group(s) such as organic acids, or more preferably fatty acids, may be neutralized in a conventional manner, with a suitable cation source. The second polymer component, which may be partially or fully neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

In one embodiment of the present invention the HNP's are ionomers and/or their acid precursors that are preferably neutralized, either fully or partially, with sufficient amount of metal base to achieve the desired neutralization level. The acid copolymers are preferably α-olefin, such as ethylene, $C_{3-8}$ α,β-ethylenically unsaturated carboxylic acid, such as acrylic and methacrylic acid, copolymers. They may optionally contain a softening monomer, such as alkyl acrylate and alkyl methacrylate, wherein the alkyl groups have from 1 to 8 carbon atoms.

The acid copolymers can be described as E/X/Y copolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer.

Specific acid-containing ethylene copolymers include, but are not limited to, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include, ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate copolymers. The most preferred acid-containing ethylene copolymers are, ethylene/(meth) acrylic acid/n-butyl, acrylate, ethylene/(meth) acrylic acid/ethyl acrylate, and ethylene/(meth) acrylic acid/methyl acrylate copolymers.

Ionomers are typically neutralized with a metal cation, such as Li, Na, Mg, K, Ca, or Zn. It has been found that by adding sufficient organic acid or salt of organic acid, along with a suitable base, to the acid copolymer or ionomer, the ionomer can be neutralized, without losing processability, to a level much greater than for a metal cation alone. Preferably, the acid moieties are neutralized greater than about 80%, preferably from 90-100%, most preferably 100% without losing processability. This is accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%).

The organic acids may be aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

The ionomers may also be more conventional ionomers, i.e., partially-neutralized with metal cations. The acid moiety in the acid copolymer is neutralized about 1 to about 90%, preferably at least about 20 to about 75%, and more preferably at least about 40 to about 70%, to form an ionomer, by a cation such as lithium, sodium, potassium, magnesium, calcium, barium, lead, tin, zinc, aluminum, or a mixture thereof.

The golf ball may also contain additives, ingredients, and other materials in amounts that do not detract from the properties of the final composition. These additive materials include, but are not limited to, activators such as calcium or magnesium oxide; fatty acids such as stearic acid and salts thereof; fillers and reinforcing agents such as organic or inorganic particles, for example, clays, talc, calcium, magnesium carbonate, silica, aluminum silicates, zeolites, powdered metals, and organic or inorganic fibers, plasticizers such as dialkyl esters of dicarboxylic acids; surfactants; softeners; tackifiers; waxes; ultraviolet (UV) light absorbers and stabilizers; antioxidants; optical brighteners; whitening agents such as titanium dioxide and zinc oxide; dyes and pigments; processing aids; release agents; and wetting agents. These compositions provide improved melt processability, and a balance of ball performance.

Blowing/foaming agents may also be compatible with and be included in golf balls of the invention, including, for example those disclosed in U.S. Pat. No. 7,708,654. Typical physical foaming/blowing agents include volatile liquids such as freons (CFCs), other halogenated hydrocarbons, water, aliphatic hydrocarbons, gases, and solid blowing agents, i.e., compounds that liberate gas as a result of desorption of gas. Preferably, the blowing agent includes an adsorbent. Typical adsorbents include, for example, activated carbon, calcium carbonate, diatomaceous earth, and silicates saturated with carbon dioxide.

Chemical foaming/blowing agents may be incorporated. Chemical blowing agents may be inorganic, such as ammonium carbonate and carbonates of alkali metals, or may be organic, such as azo and diazo compounds, such as nitrogen-based azo compounds. Suitable azo compounds include, but are not limited to, 2,2'-azobis(2-cyanobutane), 2,2'-azobis (methylbutyronitrile), azodicarbonamide, p,p'-oxybis(benzene sulfonyl hydrazide), p-toluene sulfonyl semicarbazide, p-toluene sulfonyl hydrazide. Other blowing agents include any of the Celogens®, sold by Crompton Chemical Corporation, and nitroso compounds, sulfonylhydrazides, azides of organic acids and their analogs, triazines, tri- and tetrazole derivatives, sulfonyl semicarbazides, urea derivatives, guanidine derivatives, and esters such as alkoxyboroxines. Other possible blowing agents include agents that liberate gasses as a result of chemical interaction between components such as mixtures of acids and metals, mixtures of organic acids and inorganic carbonates, mixtures of nitriles and ammonium salts, and the hydrolytic decomposition of urea.

Alternatively, low specific gravity can be achieved by incorporating low density fillers or agents such as hollow fillers or microspheres in the polymeric matrix, where the cured composition has the preferred specific gravity. Moreover, the polymeric matrix can be foamed to decrease its specific gravity, microballoons, or other low density fillers as described in U.S. Pat. No. 6,692,380 ("'380 patent"). The '380 patent is incorporated by reference in its entirety.

Blends including non-ionomeric and olefin-based ionomeric polymers may also be incorporated to form a golf ball layer. Examples of non-ionomeric polymers include vinyl resins, polyolefins including those produced using a single-site catalyst or a metallocene catalyst, polyurethanes, polyureas, polyamides, polyphenylenes, polycarbonates, polyesters, polyacrylates, engineering thermoplastics, and the like. Also, in one embodiment of the invention, processability of the golf ball of the invention may even be enhanced by incorporating in the core a metallocene-catalyzed polybutadiene.

Olefin-based ionomers, such as ethylene-based copolymers, normally include an unsaturated carboxylic acid, such as methacrylic acid, acrylic acid, or maleic acid. Other possible carboxylic acid groups include, for example, crotonic, maleic, fumaric, and itaconic acid. "Low acid" and "high acid" olefin-based ionomers, as well as blends of such ionomers, may be used. In general, low acid ionomers are considered to be those containing 16 wt. % or less of carboxylic acid, whereas high acid ionomers are considered to be those containing greater than 16 wt. % of carboxylic acid. The acidic group in the olefin-based ionic copolymer is partially or totally neutralized with metal ions such as zinc, sodium, lithium, magnesium, potassium, calcium, manganese, nickel, chromium, copper, or a combination thereof. For example, ionomeric resins having carboxylic acid groups that are neutralized from about 10 percent to about 100 percent may be used. In one embodiment, the acid groups are partially neutralized. That is, the neutralization level is from 10 to 80%, more preferably 20 to 70%, and most preferably 30 to 50%. In another embodiment, the acid groups are highly or fully neutralized. Or, the neutralization level may be from about 80 to 100%, more preferably 90 to 100%, and most preferably 95 to 100%. The blend may contain about 5 to about 30% by weight of the moisture barrier composition and about 95 to about 70% by weight of a partially, highly, or fully-neutralized olefin-based ionomeric copolymer. The above-mentioned blends may contain one or more suitable compatibilizers such as glycidyl acrylate or glycidyl methacrylate or maleic anhydride containing-polymers.

In one embodiment, the overall golf ball has a compression of from about 25 to about 110. In another embodiment, the overall golf ball has a compression of from about 35 to about 100. In yet another embodiment, the overall golf ball has a compression of from about 45 to about 95. In still another embodiment, the compression may be from about 55 to about 85, or from about 65 to about 75. Meanwhile, the compression may also be from about 50 to about 110, or from about 60 to about 100, or from about 70 to about 90, or even from about 80 to about 110.

Generally, in golf balls of the invention, the overall golf ball COR is at least about 0.780. In another embodiment, the overall golf ball COR is at least about 0.788. In yet another embodiment, the overall golf ball COR is at least about 0.791. In still another embodiment, the overall golf ball COR is at least about 0.794. Also, the overall golf ball COR may be at least about 0.797. The overall golf ball COR may even be at least about 0.800, or at least about 0.803, or at least about 0.812.

The core, intermediate layer(s) and/or cover layers may contain sections having the same hardness or different hardness levels. That is, there can be uniform hardness throughout the different sections of the core or there can be hardness gradients across the layers. For example, in single cores, there may be a hard-to-soft gradient (a "positive" gradient) from the surface of the core to the geometric center of the core. In other instances, there may be a soft-to-hard gradient (a "negative" gradient) or zero hardness gradient from the core's surface to the core's center. For dual core golf balls, the inner core layer may have a surface hardness that is less than the geometric center hardness to define a first "negative" gradient. As discussed above, an outer core layer may be formed around the inner core layer, and the outer core layer may have an outer surface hardness less than its inner surface hardness to define a second "negative" gradient. In other versions, the hardness gradients from surface to center may be hard-to-soft ("positive"), or soft-to-hard ("negative"), or a combination of both gradients. In still other versions the hardness gradients from surface to center may be "zero" (that is, the hardness values are substantially the same.) Methods for making cores having positive, negative, and zero hardness gradients are known in the art as described in, for example, U.S. Pat. Nos. 7,537,530; 7,537,529; 7,427,242; and 7,410,429, the disclosures of which are hereby incorporated by reference.

A golf ball according to the invention may therefore achieve various hardness gradients therein. For example, a golf ball of the invention having unique color appearance may incorporate a single-solid core having a "positive" hardness gradient (that is, the outer surface of the core is harder than its geometric center.) In a second embodiment, the core may be a dual-core comprising an inner core and a surrounding outer core layer. The inner core has a "positive" hardness gradient and the outer core layer has a "negative" hardness gradient (that is, the outer surface of the outer core layer is softer than the inner surface of the outer core layer.) Other embodiments of golf balls having various combinations of positive, negative, and zero hardness gradients may be made in accordance with this invention. For example, the inner core may have a positive hardness gradient and the outer core layer also may have a positive hardness gradient. In another example, the inner core may have a positive hardness gradient and the outer core layer may have a "zero" hardness gradient. (That is, the hardness values of the outer surface of the outer core layer and the inner surface of the outer core layer are substantially the same.) Particularly, the term, "zero hardness gradient" as used herein, means a surface to center Shore C hardness gradient of less than 8, preferably less than 5 and most preferably less than 3 and may have a value of zero or negative 1 to negative 25. The term, "negative hardness gradient" as used herein, means a surface to center Shore C hardness gradient of less than zero. The terms, zero hardness gradient and negative hardness gradient, may be used herein interchangeably to refer to hardness gradients of negative 1 to negative 25. The term, "positive hardness gradient" as used herein, means a surface to center Shore C hardness gradient of 8 or greater, preferably 10 or greater, and most preferably 20 or greater. By the term, "steep positive hardness gradient" as used herein, it is meant surface to center Shore C hardness gradient of 20 or greater, more preferably 25 or greater, and most preferably 30 or greater. Methods for measuring the hardness of the inner core and surrounding layers and determining the hardness gradients are discussed in further detail below.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within 0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

The outer surface hardness of a golf ball layer is measured on the actual outer surface of the layer and is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to ensure that the golf ball or golf ball subassembly is centered under the durometer indentor before a surface hardness reading is obtained. A calibrated, digital durometer, capable of reading to 0.1 hardness units may be used for the hardness measurements. The digital durometer is attached to, and its foot made parallel to, the base of an automatic stand. The weight on the durometer and attack rate conform to ASTM D-2240. In certain embodiments, a point or plurality of points measured along the "positive" or "negative" gradients may be above or below a line fit through the gradient and its outermost and innermost hardness values. In an alternative preferred embodiment, the hardest point along a particular steep "positive" or "negative" gradient may be higher than the value at the innermost portion of the inner core (the geometric center) or outer core layer (the inner surface)—as long as the outermost point (i.e., the outer surface of the inner core) is greater than (for "positive") or lower than (for "negative") the innermost point (i.e., the geometric center of the inner core or the inner surface of the outer core layer), such that the "positive" and "negative" gradients remain intact.

As discussed above, the direction of the hardness gradient of a golf ball layer is defined by the difference in hardness measurements taken at the outer and inner surfaces of a particular layer. The center hardness of an inner core and hardness of the outer surface of an inner core in a single-core ball or outer core layer are readily determined according to the test procedures provided above. The outer surface of the inner core layer (or other optional intermediate core layers) in a dual-core ball are also readily determined according to the procedures given herein for measuring the outer surface hardness of a golf ball layer, if the measurement is made prior to surrounding the layer with an additional core layer. Once an additional core layer surrounds a layer of interest, the hardness of the inner and outer surfaces of any inner or intermediate layers can be difficult to determine. Therefore, for purposes of the present invention, when the hardness of the inner or outer surface of a core layer is needed after the inner layer has been surrounded with another core layer, the test procedure described above for measuring a point located 1 mm from an interface is used.

Also, it should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers, and thickness of the various layers. It also should be understood that the two measurement techniques are not linearly related and, therefore, one hardness value cannot easily be correlated to the other. Shore C hardness was measured according to the test methods D-2240.

Several different methods can be used to measure compression, including Atti compression, Riehle compression, load/deflection measurements at a variety of fixed loads and offsets, and effective modulus. See, e.g., Compression by Any Other Name, Science and Golf IV, Proceedings of the World Scientific Congress of Golf (Eric Thain ed., Routledge, 2002) ("J. Dalton") The term compression, as used herein, refers to Atti or PGA compression and is measured using an Atti compression test device. A piston compresses a ball against a spring and the piston remains fixed while deflection of the spring is measured at 1.25 mm (0.05 inches). Where a core has a very low stiffness, the compression measurement will be zero at 1.25 mm. In order to measure the compression of a core using an Atti compression tester, the core must be shimmed to a diameter of 1.680 inches because these testers are designed to measure objects having that diameter. Atti compression units can be converted to Riehle (cores), Riehle (balls), 100 kg deflection, 130-10 kg deflection or effective modulus using the formulas set forth in J. Dalton. The approximate relationship that exists between Atti or PGA compression and Riehle compression can be expressed as: (Atti or PGA compression)=(160-Riehle Compression). Thus, a Riehle compression of 100 would be the same as an Atti compression of 60.

COR, as used herein, is determined by firing a golf ball or golf ball subassembly (e.g., a golf ball core) from an air cannon at two given velocities and calculating the COR at a velocity of 125 ft/s. Ball velocity is calculated as a ball approaches ballistic light screens which are located between the air cannon and a steel plate at a fixed distance. As the ball travels toward the steel plate, each light screen is activated, and the time at each light screen is measured. This provides an incoming transit time period inversely proportional to the ball's incoming velocity. The ball impacts the steel plate and rebounds through the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$. Preferably, a golf ball according to the present invention has a COR of at least about 0.78, more preferably, at least about 0.80.

The spin rate of a golf ball also remains an important golf ball characteristic. High spin rate allows skilled players more flexibility in stopping the ball on the green if they are able to control a high spin ball. On the other hand, recreational players often prefer a low spin ball since they do not have the ability to intentionally control the ball, and lower spin balls tend to drift less off the green.

Golf ball spin is dependent on variables including, for example, distribution of the density or specific gravity within a golf ball. For example, when the center has a higher density or specific gravity than the outer layers, a lower moment of inertia results which increases spin rate. Alternatively, when the density or specific gravity is concentrated in the outer regions of the golf ball, a higher moment of inertia results with a lower spin rate. The moment of inertia for a golf ball of the invention may be from about 0.410 oz-in$^2$ to about 0.470 oz-in$^2$. The moment of inertia for a one piece ball that is 1.62 ounces and 1.68 inches in diameter may be approximately 0.4572 oz-in$^2$, which is the baseline moment of inertia value.

Accordingly, by varying the materials and the density of the regions of each core or cover layer, different moments of inertia may be achieved for the golf ball of the present invention. In one embodiment, the resulting golf ball has a moment of inertia of from about to 0.440 to about 0.455 oz-in$^2$. In another embodiment, the golf balls of the present invention have a moment of inertia of from about 0.456 oz-in$^2$ to about 0.470 oz-in$^2$. In yet another embodiment, the golf ball has a moment of inertia of from about 0.450 oz-in$^2$ to about 0.460 oz-in$^2$.

Unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Examples of such modifications include reasonable variations of the numerical values and/or materials and/or components discussed above. Hence, the numerical values stated above and claimed below specifically include those values and the values that are approximate to those stated and claimed values. Therefore, it will be understood that the appended claims are intended to cover all such modifications and embodiments, which would come within the spirit and scope of the present invention.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. For example, the compositions of the present invention may be used in a variety of equipment. Such modifications are also intended to fall within the scope of the appended claims.

While any of the embodiments herein may have any known dimple number and pattern, a preferred number of dimples is 252 to 456, and more preferably is 300 to 392. The dimples may comprise any width, depth, and edge angle and patterns which satisfy the relationships defined between cover layers as disclosed herein. The parting line configuration of said pattern may be either a straight line or a staggered wave parting line (SWPL). In one embodiment, the golf ball has 302, 320, 328, 330, 332, 352 or 392 dimples, comprises 5 to 7 dimples sizes, and the parting line is a SWPL.

In any of these embodiments the single-layer core may be replaced with a two or more layer core wherein at least one core layer has a negative hardness gradient. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range.

Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

What is claimed is:

1. A golf ball having two layers which contribute to an overall color appearance of the golf ball, the two layers comprising an inner layer and an outer layer;

the inner layer and outer layer each comprised of two different colors, the inner layer comprising a colored region W having a surface area A and a colored region X having a surface area B;

wherein either $A \neq B$ or $A=B$;

the outer layer comprising a colored region Y having a surface area C and a colored region Z having a surface area D such that $C=D$; and color regions Y and Z have a boundary P such that for $A=B$, where boundary P is orthogonal to a boundary L of color regions W and X, and color regions Y and Z are translucent, the golf ball has an overall color appearance comprised of four different colors;

wherein boundary P is not a parting line and/or is non-planar; and wherein boundary L is not a parting line and/or is non-planar.

2. A golf ball having two layers which contribute to the overall color appearance of the golf ball, the two layers comprising an inner layer and an outer layer;

the inner layer comprised of at least three different colors and the outer layer comprised of two different colors, the inner layer comprising a first color region W, a second color region X and a third color region T;

the outer layer comprising a fourth color region Y and a fifth color region Z;

wherein color regions Y and Z are translucent; and wherein color regions Y and Z have a boundary P that intersects at least one of color region X and color region T such that the golf ball has an overall color appearance comprised of three different colors; and wherein boundary P is non-planar and/or is not a parting line.

3. A golf ball having two layers which contribute to the overall color appearance of the golf ball, the two layers comprising an inner layer and an outer layer;

the inner layer comprised of at least three different colors and the outer layer comprised of two different colors, the inner layer comprising a first color region W, a second color region X and a third color region T;

the outer layer comprising a fourth color region Y and a fifth color region Z;

wherein color regions Y and Z are translucent; and wherein color regions Y and Z have a boundary P and the outer layer is positioned and aligned about the inner layer such that boundary P intersects each of color region W, color region X and color region T and the golf ball has an overall color appearance comprised of six different colors; and wherein boundary P is non-planar and/or is a not a parting line.

* * * * *